US007441395B2

(12) United States Patent
Feuerlohn et al.

(10) Patent No.: US 7,441,395 B2
(45) Date of Patent: Oct. 28, 2008

(54) DRAFTING ARRANGEMENT FOR A SPINNING MACHINE

(75) Inventors: Helmut Feuerlohn, Mönchengladbach (DE); Christoph Haase, Viersen (DE); Thomas Weide, Mönchengladbach (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 148 days.

(21) Appl. No.: 11/507,790

(22) Filed: Aug. 22, 2006

(65) Prior Publication Data

US 2007/0044277 A1 Mar. 1, 2007

(30) Foreign Application Priority Data

Aug. 25, 2005 (DE) ..... 10 2005 040 144

(51) Int. Cl.
*D01H 5/00* (2006.01)

(52) U.S. Cl. ..... 57/315; 19/236

(58) Field of Classification Search ..... 57/315; 19/236, 244, 294

See application file for complete search history.

(56) References Cited

U.S. PATENT DOCUMENTS 5,022,123 A 6/1991 Ueda et al. ..... 19/260
5,809,762 A * 9/1998 Gohler ..... 57/315

FOREIGN PATENT DOCUMENTS

| | | |
|---|---|---|
| DE | 39 32 614 A1 | 4/1990 |
| DE | 39 41 823 C1 | 5/1991 |
| DE | 41 22 883 A1 | 1/1993 |
| DE | 94 01 579.1 | 5/1994 |
| DE | 100 40 420 A1 | 2/2002 |

OTHER PUBLICATIONS

German Search Report.

* cited by examiner

*Primary Examiner*—Shaun R Hurley
(74) *Attorney, Agent, or Firm*—K&L Gates LLP

(57) ABSTRACT

A drafting arrangement for a spinning machine, comprising at least one pair of feed rollers, one pair of central rollers and a pair of withdrawal rollers, wherein the lower rollers of the drafting arrangement are configured as roller segments, which are rotated by single-motor drives, and the upper rollers are mounted in a pendulum carrier. The lower roller drive (14) at least of the pair of central rollers (21) is arranged together with its lower roller (21A) in a bearing device (15) in such a way that, after opening of the pendulum carrier (17) receiving the associated upper roller (21B), the lower roller (21A) and its drive (14) can easily be removed from the bearing device (15) in the direction of the pendulum carrier (17).

8 Claims, 4 Drawing Sheets

DRAFTING ARRANGEMENT FOR A SPINNING MACHINE

CROSS-REFERENCE TO RELATED APPLICATIONS

This application claims the benefit of German patent application 102005040144.9 filed Aug. 25, 2005, herein incorporated by reference.

BACKGROUND OF THE INVENTION

The invention relates generally to a drafting arrangement for a spinning machine and, more particularly, to such a drafting arrangement comprising at least one pair of feed rollers, one pair of central rollers and a pair of withdrawal rollers, wherein each roller pair comprising an upper roller and a lower roller with the lower rollers of the drafting arrangement being configured as roller segments, which are rotated by single-motor drives, and the upper rollers being mounted in a pendulum carrier.

In conjunction with spinning machines, for example with ring spinning machines or air spinning machines, drafting arrangements are known in various embodiments. The drafting arrangements differ here, sometimes substantially, for example, with regard to the number of their pairs of rollers, with respect to the structural design of their pendulum carriers or else with regard to the configuration of their lower rollers.

In particular in conjunction with ring spinning machines, drafting arrangements with lower rollers along the length of the machine are very widespread, for example. These lower rollers along the length of the machine are generally driven by a strong drafting arrangement motor which is arranged at the end of the machine in the drive frame of the textile machine and which ensures, via an interposed reduction gear, that the feed, central and withdrawal lower rollers rotate at different speeds and draw the presented fiber band (e.g., a sliver) in the process.

Such lower rollers along the length of the machine have a series of disadvantages, however. It is not only the bearing holding of such long lower rollers which is often rather difficult, changing the drawing conditions of the drafting arrangements generally also entails substantial outlay. Such long lower rollers are also subjected to high torsional stresses during the spinning operation and are inclined to distortions, which has a very negative effect on the quality of the drawing that is adjusted.

As in these lower rollers the assembly or replacement of the drawing belts, which are preferably arranged in the region of the central lower roller and are subjected to relatively high wear, is very expensive, various proposals have already been made in the past, as to how such long lower rollers can be replaced or modified in such a way that the aforementioned disadvantages do not occur.

To avoid high torsional stresses in long lower rollers, it has been proposed, for example, in German Patent Publication DE 100 40 420 A1, to either drive each of these lower rollers along the length of the machine by a plurality of accordingly weaker motors or to divide the lower rollers into a plurality of lower roller sections which can be driven individually. According to an embodiment shown in German Patent Publication DE 100 40 420 A1, arranged distributed over the entire length of a lower roller along the length of a machine are, for example, two or three motors, which together drive the lower roller. In the case of divided lower rollers, an individual separate drive is provided for each of the individual lower roller sections.

Although the devices described in German Patent Publication DE 100 40 420 A1 succeed in keeping the torsional stresses in the lower rollers within reasonable limits, in particular in the case of very long ring spinning machines, the other disadvantages of lower rollers of this type, in particular with regard to the assembly outlay during installation or when changing the drawing belts arranged in the region of the central lower rollers, could not be eliminated, however, with these devices.

A ring spinning machine is described in German Patent Publication DE 39 41 823 C1, which, instead of lower rollers along the length of the machine, in each case has a large number of relatively short lower roller sections which are driven by a single motor and, in conjunction with corresponding upper rollers, form the drafting arrangements. The lower roller sections are configured here as external rotor drives. In other words, a bearing axle is fixed so as to be rotationally engaged between two cheeks of the machine frame of the ring spinning machine and carries the stator of the external rotor drive. The electric rotor of the drive is arranged inside a rotatable hollow roller, which is also supported via corresponding bearing points on the bearing axle. The associated upper rollers, which are entrained by frictional engagement during the spinning operation of the lower roller section, rest on the hollow roller, which in each case forms a lower roller section for a plurality of spinning station drafting arrangements arranged next to one another.

German Patent Publication DE 39 41 823 A1 does not contain any more detailed indications, however, as to how the bearing points are formed in the cheeks of the ring spinning machine. In other words, it is not described anywhere in this patent whether the bearing axles are arranged so as to be stationary or replaceable, for example.

Drafting arrangements for spinning machines, which in each case have lower roller segments which can be driven by a single motor, are also known from German Patent Publication DE 39 32 614 A1.

In these known drafting arrangements, the individual drives of the lower roller segments are connected to a control device, which, via a corresponding inverter, can adjust the speed of the drives and therefore the drawing of the drafting arrangement. The lower roller segments are either connected here via a motor shaft directly to one of the drives or connected in each case to one of the drives via a drive belt.

It is also not shown or described in German Patent Publication DE 39 32 614 A1 how a bearing arrangement could appear in order to arrange lower roller drives, which are connected directly to a lower roller segment via their motor shaft, so as to be easily replaceable, in the machine frame of a textile machine, for example to change the drawing belts. In this patent, a bearing arrangement is merely described with the aid of an embodiment, in which the lower roller segments are connected to the drives via drive belts In this case, both the lower roller segments and the drives are displaceably mounted in longitudinal guides via special bearing parts such that the spacing between the roller segments can be adjusted and changed if necessary. To disassemble the lower roller segments and/or the drives, the respective longitudinal guides firstly have to be laboriously unscrewed from one another.

SUMMARY OF THE INVENTION

Proceeding from drafting arrangements of the type described above, the present invention is based on the object of providing a drafting arrangement, the lower rollers of which are configured as roller segments and are very accessible and easy to disassemble if necessary, in particular to change the drawing belts.

This object is achieved according to the invention by a drafting arrangement, adapted for a spinning machine, and basically comprising at least one pair of feed rollers, one pair of central rollers and a pair of withdrawal rollers, wherein each roller pair comprises an upper roller and a lower roller with the lower rollers of the drafting arrangement being configured as roller segments, which are rotated by single-motor drives, and the upper rollers are mounted in a pendulum carrier, characterized in that the lower roller drive of at least the pair of central rollers is arranged together with the respective associated lower roller in a bearing device in such a way that, after opening of the pendulum carrier receiving the respective associated upper roller, the lower roller drive and the respective associated lower roller can easily be removed from the bearing device in the direction of the pendulum carrier.

Advantageous further embodiments, features and characteristics of the preferred embodiments of the present invention are described more fully hereinafter.

The drafting arrangement according to the invention has the advantage, in particular, that after opening the pendulum carrier, the lower roller drives, including the associated roller segments, can be immediately removed without any problems in the direction of the pendulum carrier from their bearing devices. In other words, to assemble or disassemble the single motor-driven lower roller segments, no tool or the like is required. In the case of disassembled lower roller segments, the drawing belts, which are preferably arranged in the region of the lower roller segments of the central lower roller, are freely accessible and can be changed quickly and without any problems if necessary.

In an advantageous embodiment it is provided that the bearing devices for the lower roller drives have receiving pockets and can be fixed, for example, by means of studs to a frame, which is in turn fastened to the machine frame of the air spinning machine. In other words, during the spinning operation, the lower roller drives and therefore also the associated lower roller segments are aligned precisely in their working positions and are thus fixed reliably in the receiving pockets of the bearing devices by the closed pendulum carrier. By opening the pendulum carrier, the lower roller drives are released and can therefore easily be lifted out of the bearing devices together with their associated lower roller segments. Installation of the lower roller segments is therefore free of problems. The lower roller drives are simply placed from above into the open bearing devices and are immediately correctly aligned in the process.

According to another feature of the invention, it is provided in an advantageous embodiment that the internal dimensions of the receiving pockets of the bearing devices are matched to the outer contours of the lower roller drives. In bearing devices configured in this way, the lower bearing drives and therefore also the lower roller segments are securely and reliably positioned both when the pendulum carrier is open and also during the spinning process when the pendulum carrier is closed.

A further feature of the invention provides that at least the central lower roller is advantageously multi-part. In other words, at least the central lower roller consists of two lower roller segments, which are in turn connected so as to be rotationally engaged on a lower roller drive and can be rotated relative to one another. In this manner, it is ensured, on the one hand, that the central lower roller can be divided without any problems if necessary in such a way that the drawing belts can easily be changed. The relative movement of the lower roller segments with respect to one another also allows a separate drive of the two drafting arrangements sides. In other words, when there is a thread break, in which one side of the drafting arrangement is stopped, the other side of the drafting arrangement can remain in operation.

In a preferred embodiment, the drives of the lower roller segments of the feed lower roller and the drives of the lower roller segments of the central lower roller are configured as stepping motors. Stepping motors of this type are proven and economical mass produced components, which can also be relatively easily controlled, for example with respect to their speed. In other words, via a corresponding, relatively simple control device, the desired drawing of the drafting arrangement can be precisely adjusted via the speeds of the feed lower roller and the central lower roller and, if necessary, can also be corrected without any great outlay.

According to another aspect of the invention, the lower roller segments have a bearing stump, in each case, in the region of their free end, which projects into a bearing sleeve in the installed state of the lower roller segments. The bearing sleeve is equipped with roller bearings, on which the bearing stumps are supported. An arrangement of this type, on the one hand, allows the lower roller segments to be taken apart easily if necessary, for example to change the drawing belts, and, on the other hand, ensures that the lower roller segments cannot be tilted during the spinning operation by the upper rollers mounted in the pendulum carrier and acting on the lower roller segments.

BRIEF DESCRIPTION OF THE DRAWINGS

The invention will be described in more detail hereinafter with the aid of an embodiment shown in the drawings, in which.

DESCRIPTION OF THE PREFERRED EMBODIMENT

Figure 1:
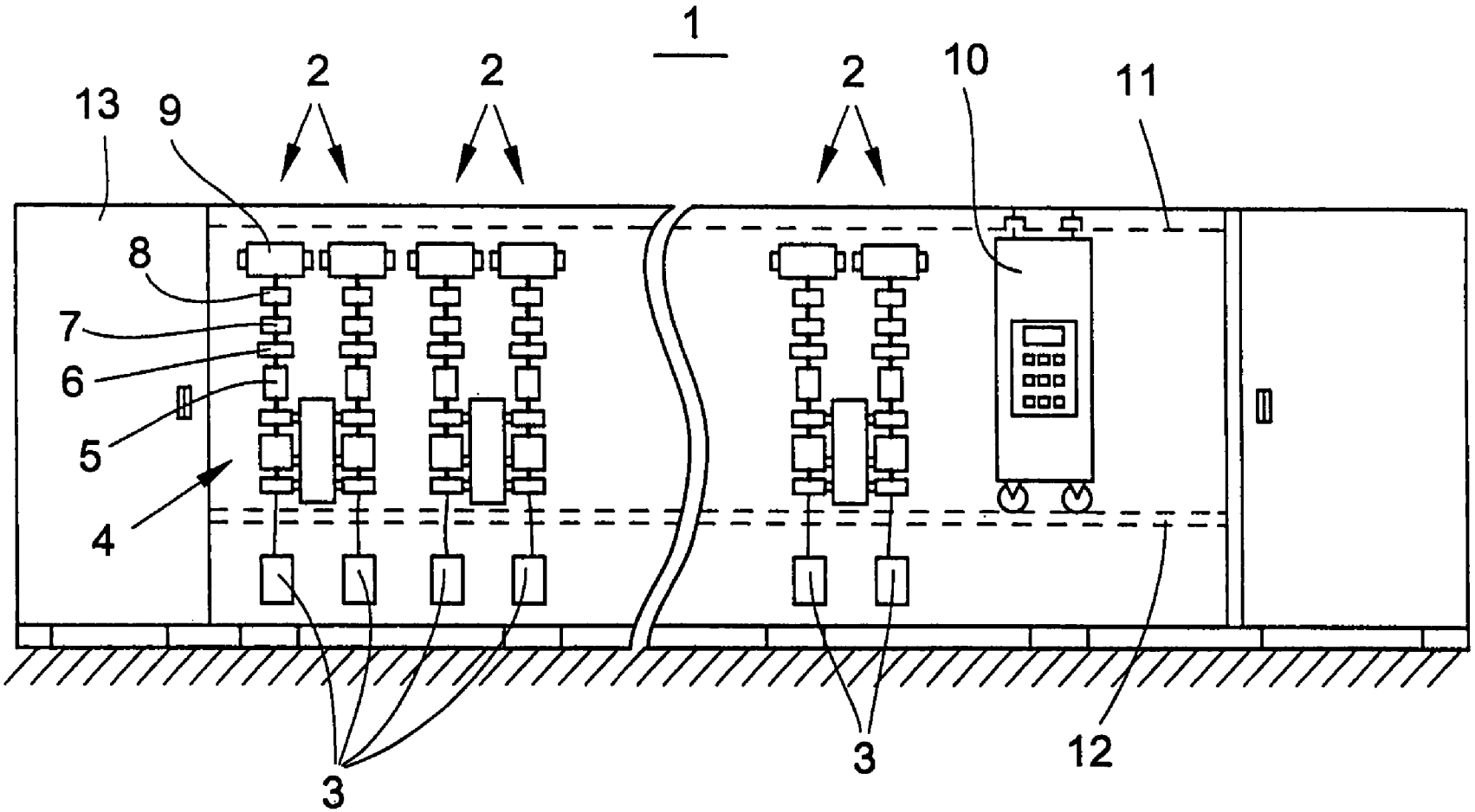
FIG. 1 schematically shows a front view of an air spinning machine, which is equipped with the drafting arrangements configured according to the invention.
Figure 2:
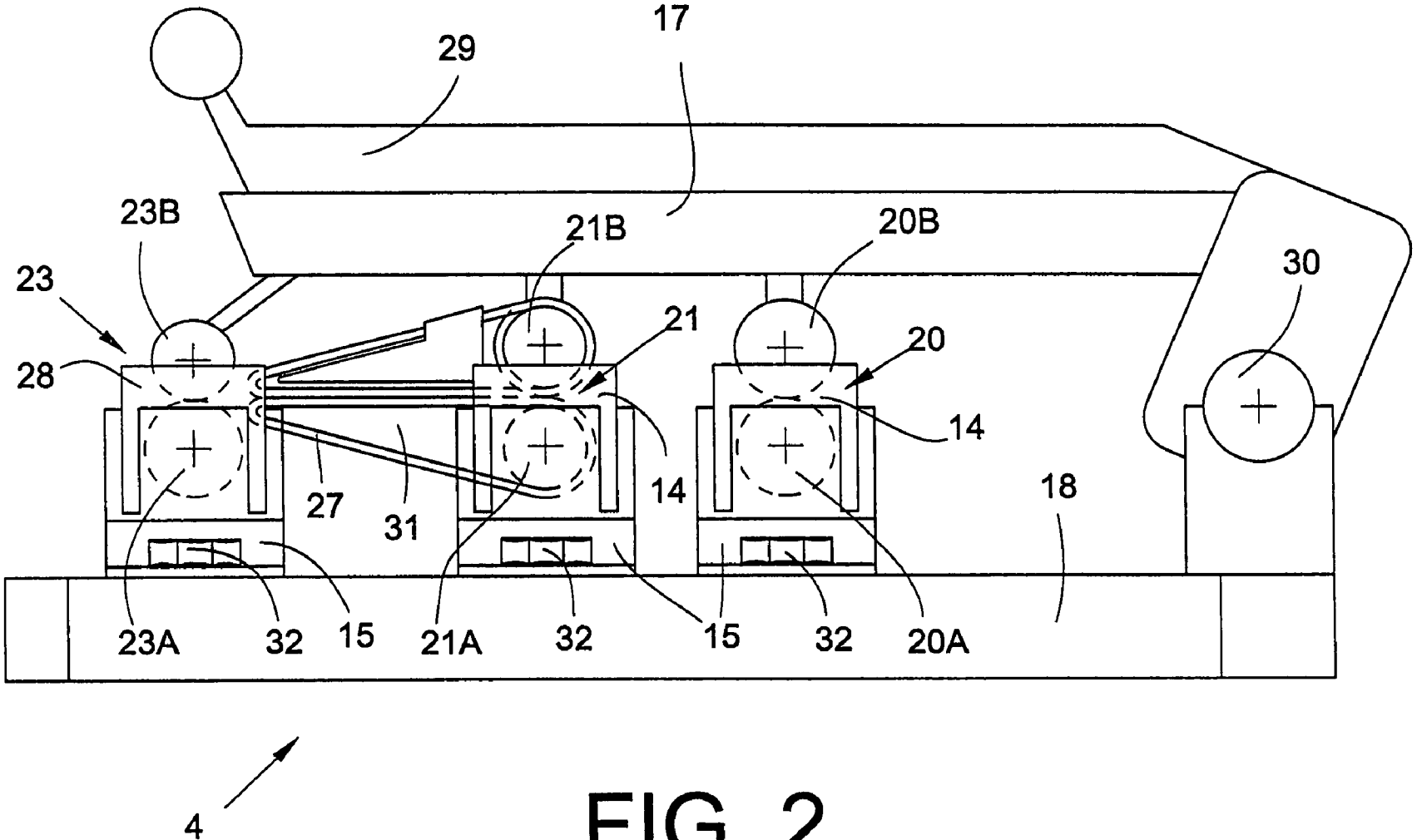
FIG. 2 shows a side view of the drafting arrangement according to the invention, the lower roller drives being fixed in bearing devices by the closed pendulum carrier.

FIG. 1 shows the drafting arrangement 4 according to the invention schematically in conjunction with an air spinning machine 1. Textile machines of this type generally have a large number of workstations 2 arranged in series next to one another and a so-called end frame 13 at at least one end of the air spinning machine 1. As known, each of the workstations or spinning stations 2 of an air spinning machine 1 of this type has a fiber band (sliver) source, for example a spinning can 3, a drafting arrangement 4, an air spinning mechanism 5, a thread withdrawal device 6, a yarn clearer 7 and a thread traversing device 8. The thread traversing device 8 ensures that the thread produced in the air spinning mechanism 5 is wound in crossing layers on a take-up bobbin 9. The cross-wound bobbin as conventional, is held in a creel (not shown)

and is rotated by a bobbin drive (also not shown). As also indicated in FIG. 1, the spinning stations 2 of the air spinning machine 1 are supplied by an automatically operating service traveler 10 which, guided on rails 11, 12, can be moved along the spinning stations 2.

Figure 3:
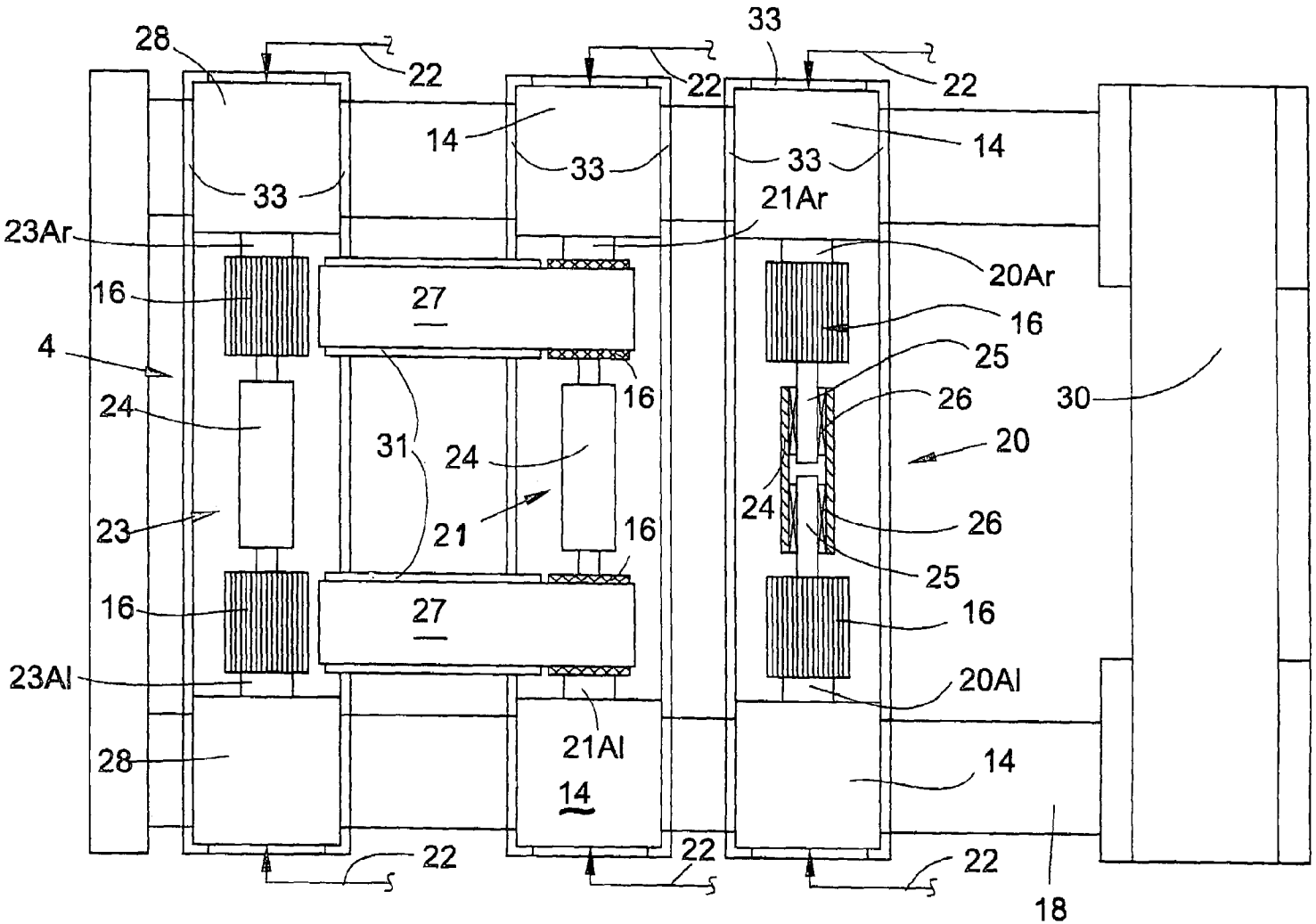
FIG. 3 shows a plan view of the drafting arrangement according to the invention, without a pendulum carrier.

As can be seen, in particular, from FIG. 3, the lower rollers 20A, 21A, 23A are composed in turn of lower roller segments, in each case, 2OA1, 2OAr; 21A1, 21Ar; 23A1, 23Ar, which can in each case be rotated by a lower roller drive 14 or 28. The lower roller segments 2OA1, 2OAr; 21A1, 21Ar; 23A1, 23Ar are connected, in this case, so as to be rotationally engaged, to the motor shafts of the lower roller drives 14 or 28, which are in turn connected to a power source, not shown, and a control device, also not shown, via supply and signal lines 22. The lower roller segments 2OA1, 2OAr; 21A1, 21Ar; 23A1, 23Ar, apart from a structured working face 16, in the region of their free end, in each case have a bearing stump 25. In the installed state of the lower roller segments, these bearing stumps 25 are guided in bearing sleeves 24, which have roller bearings 26, preferably needle bearings. Drawing belts 27, which, as conventional, are guided on deflection rails 31, are also arranged in the region of the lower roller segments 21A1, 21Ar of the central lower roller 21.

The lower roller drives 14 or 28 are arranged so as to be easily replaceable in bearing devices 15, which are fastened via studs 32 on a frame 18, which is in turn fastened to the machine frame of the air spinning machine 1.

Figure 4:
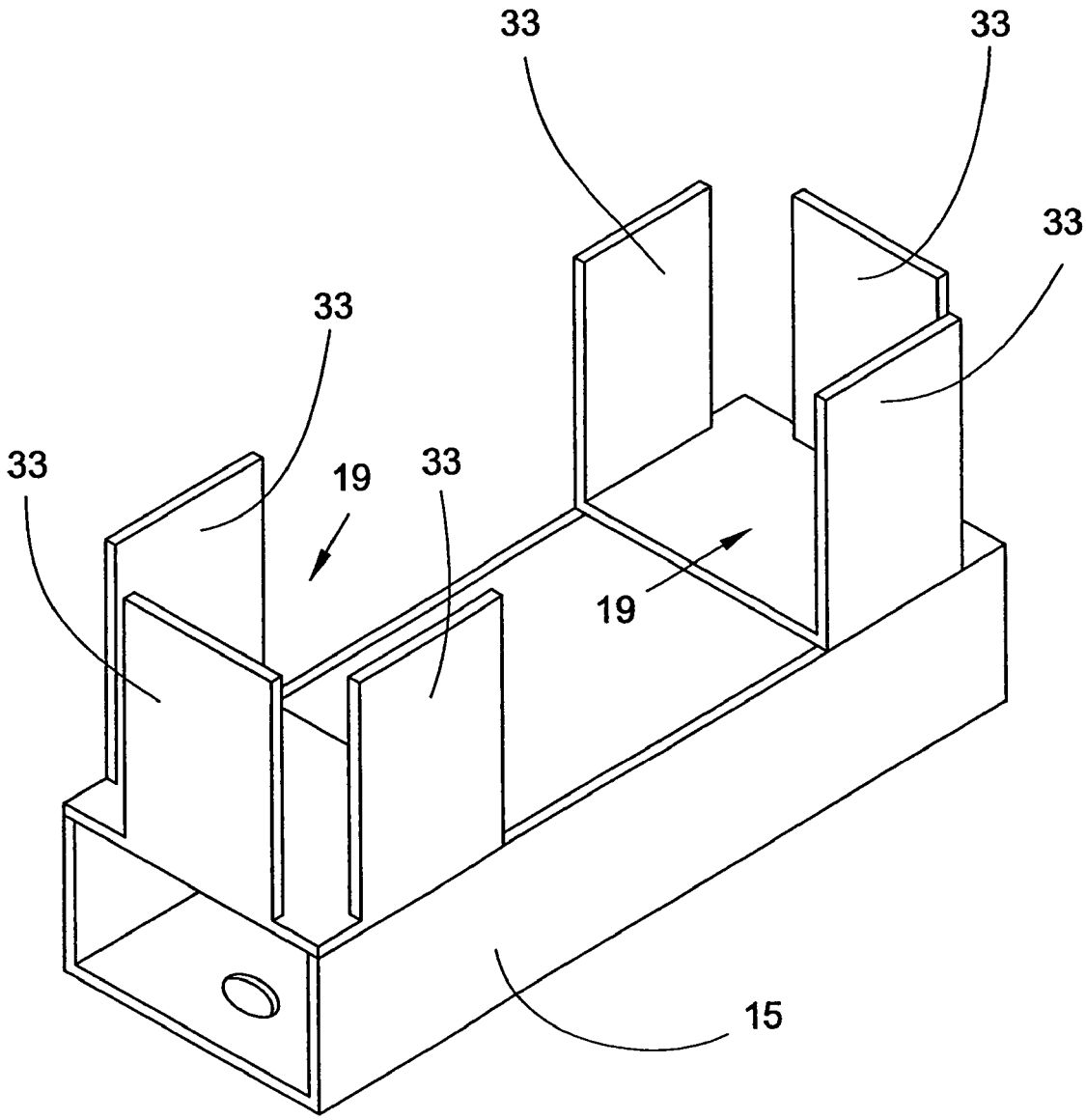
FIG. 4 shows a perspective view of a bearing device for receiving the lower roller driver.

The bearing devices 15, which are shown perspectively in FIG. 4, have upwardly open receivers 19 with lateral limiting walls 33. The open receivers 19 of the bearing devices 15 are designed with respect to their internal dimensions in relation to the contour of the lower roller drives 14, 28 in such a way that the lower roller drives 14, 28, after their positioning in the bearing devices 15, are located precisely in their working position and can be fixed by closing the pendulum carrier 17.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A drafting arrangement for a spinning machine, comprising at least one pair of feed rollers, one pair of central rollers and a pair of withdrawal rollers, each roller pair comprising an upper roller and a lower roller wherein the lower rollers of the drafting arrangement are configured as roller segments, which are rotated by single-motor drives, and the upper rollers are mounted in a pendulum carrier, characterized in that the lower roller drive (14) of at least the pair of central rollers (21) is arranged together with the respective associated lower roller (21A) in a bearing device (15) without assembly to other components in such a way that, after opening of the pendulum carrier (17) receiving the respective associated upper roller (21B), the lower roller drive (14) and the respective associated lower roller (21A) can easily be removed from the bearing device (15) in the direction of the pendulum carrier (17) without the use of tools and without required disassembly of other associated components.

2. The drafting arrangement according to claim 1, characterized in that the bearing device (15) has a receiving pocket (19), and is fixed, by means of studs (20), to a frame (18), which is in turn fastened to the machine frame of the spinning machine (1).

3. The drafting arrangement according to claim 2, characterized in that the internal dimensions of the receiving pocket (19) is matched to the outer contour of the lower roller drive (14).

4. The drafting arrangement according to claim 1, characterized in that at least the central lower roller (21A) is multipart comprising lower roller segments (21A1, 21Ar) which can be rotated relative to one another.

5. The drafting arrangement according to claim 1, characterized in that the lower roller drive (14) is configured as a stepping motor.

6. The drafting arrangement according to claim 4, characterized in that the lower roller segments (21A1, 21Ar), in the region of a free end thereof, each have a bearing stump (25), which is guided in a bearing sleeve (24) in an installed state of the lower roller segments.

7. The drafting arrangement according to claim 6, characterized in that the bearing sleeve (24) is equipped with roller bearings (26) for the freely rotatable mounting of the lower roller segments (21A1, 21Ar).

8. The drafting arrangement according to claim 1, characterized in that the lower roller drive (14) of each pair of rollers (20, 21, 23) is arranged together with the respective associated lower roller (20A, 21A, 23A) in a respectively associated bearing device (15) in such a way that, after opening of the pendulum carrier (17) receiving the respective associated upper rollers (20B, 21B, 23B), the lower roller drives (14) and the respective associated lower rollers (20A, 21A, 23A) can easily be removed from the bearing devices (15) in the direction of the pendulum carrier (17).

* * * * *